United States Patent [19]

Smith et al.

[11] 4,344,370

[45] Aug. 17, 1982

[54] APPARATUS FOR DISCHARGING EXHAUST GAS AT HIGH VELOCITY

[75] Inventors: W. Christen Smith, Terrace Park; Terry J. McGill, Cincinnati; Herbert L. Spangler, Bethel, all of Ohio

[73] Assignee: Industrial Air, Inc., Amelia, Ohio

[21] Appl. No.: 172,015

[22] Filed: Jul. 24, 1980

[51] Int. Cl.[3] ..... F23L 17/02

[52] U.S. Cl. ..... 110/162; 98/60; 98/78

[58] Field of Search ..... 98/20, 58, 60, 70, 78; 110/160, 162, 184

[56] References Cited

U.S. PATENT DOCUMENTS

| | | | |
|---|---|---|---|
| 1,244,334 | 10/1917 | Ilg . | |
| 1,263,833 | 4/1918 | Akerlund . | |
| 1,271,333 | 7/1918 | Lind et al. . | |
| 1,986,176 | 1/1935 | Zwerling | 98/78 X |
| 2,184,647 | 12/1939 | Lane | 110/162 X |
| 2,300,578 | 11/1942 | Lane | 110/162 |
| 2,713,301 | 7/1955 | Mckann . | |
| 2,714,847 | 8/1955 | Svebel | 98/58 |
| 3,069,071 | 12/1962 | Carlson . | |
| 3,211,080 | 10/1965 | Rader | 98/58 X |
| 3,229,896 | 1/1966 | Levy . | |
| 3,233,567 | 2/1966 | Goldfield . | |
| 3,487,767 | 1/1970 | Kristiansen . | |
| 3,570,423 | 3/1971 | Hemmingson . | |
| 3,592,122 | 7/1971 | Hughes . | |
| 3,722,396 | 3/1973 | Peill et al. . | |
| 3,817,162 | 6/1974 | Guelph | 98/58 |

FOREIGN PATENT DOCUMENTS

| | | | |
|---|---|---|---|
| 18230 | of 1908 | United Kingdom | 98/58 |

*Primary Examiner*—Albert J. Makay
*Assistant Examiner*—Harold Joyce
*Attorney, Agent, or Firm*—Wood, Herron & Evans

[57] ABSTRACT

A roof-mounted apparatus is disclosed for discharging exhaust gas at a high velocity. The apparatus includes a stack having a tapered annular cross-section for achieving a relatively high discharge velocity for exhaust gas so that the effective height of the stack is equivalent to that of a considerably taller conventional chimney. The tapered annular stack preferably includes an outer wall and a coaxial inner wall which tapers outwardly toward the outer wall from the bottom to the top of the stack. An in-line fan having an annular outlet which communicates with the bottom of the tapered annular stack is preferably included for impelling exhaust gas admitted to the inlet of the fan into the stack. The inlet of the in-line fan preferably communicates with the outlet of a mixing chamber which is included for mixing diluent fresh air with exhaust gas admitted to the inlet of the mixing chamber through the roof of an industrial plant for diluting the exhaust gas as well as increasing the volume of gas to be discharged in order to achieve the desired discharge velocity. Other features, such as a system for cooling the motor included in the in-line fan, are also disclosed.

10 Claims, 3 Drawing Figures

APPARATUS FOR DISCHARGING EXHAUST GAS AT HIGH VELOCITY

BACKGROUND OF THE INVENTION

This invention relates to industrial exhaust and ventilation systems and, more particularly, to apparatus for discharging fumes and gases evolved during industrial processes in such a way that they are dispersed without creating health hazards or damaging the air quality in the vicinity of an industrial plant. Specifically, the invention is directed to an apparatus for discharging exhaust gas at a high discharge velocity as an alternative for a conventional chimney.

Fumes and gases are evolved during many industrial processes, especially chemical processes, as well as processes such as de-greasing and electroplating metal, fabricating semiconductor devices, etc. The effluent fumes and gases are often quite caustic and dangerous in concentrated form and must be conveyed out of the industrial plant in order to avoid health hazards for the workers. Furthermore, the effluent fumes and gases must be discharged into the atmosphere so as not to create health hazards or damage the air quality of the geographical area which surrounds the industrial plant.

Traditionally, industrialized areas are marked by tall chimneys which tower above industrial plants for discharging fumes and gases evolved during industrial processes at a height which causes dispersion of the effluent fumes and gases without creating danger or annoyance for persons near the plants. Conventionally, the chimneys are cylindrical and in some instances are tapered inwardly from the bottom to the top of the chimney for contracting the stream of exhaust gas in order to maintain a desired discharge velocity at the top of the chimney. Such chimneys are costly because of the large amount of materials used in construction and are often an unsightly addition to the skyline.

SUMMARY OF THE INVENTION

One objective of this invention is to provide an alternative for a conventional chimney in the form of an apparatus for discharging effluent fumes and gases at high velocity, thereby providing a less costly and more aesthetic exhaust or ventilation system.

Another objective is to provide an apparatus for discharging effluent fumes and gases which includes a stack for achieving a relatively high discharge velocity so that the stack is equivalent to a considerably taller conventional chimney.

A further objective is to provide an apparatus for discharging effluent fumes and gases which includes an in-line fan combined with a stack for impelling effluent fumes and gases into the stack so that they are discharged at a high velocity.

A subsidiary objective is to provide a high discharge velocity exhaust system including a stack and an in-line fan combined with the stack for impelling effluent fumes and gases into the stack which further includes means for cooling the fan motor.

An additional objective is to provide an apparatus for discharging effluent fumes and gases including a stack and an in-line fan combined with the stack for impelling effluent fumes and gases into the stack which further includes a mixing chamber for diluting the effluent fumes and gases as well as increasing the volume of gas to be discharged in order to achieve the desired discharge velocity.

In accordance with a preferred embodiment of this invention, a roof-mounted apparatus is provided for discharging exhaust gas at a high velocity. The apparatus includes a stack having a tapered annular cross-section for achieving a relatively high discharge velocity for exhaust gas so that the effective height of the stack is equivalent to that of a considerably taller conventional chimney. The tapered annular stack preferably includes an outer wall and a coaxial inner wall which tapers outwardly toward the outer wall from the bottom to the top of the stack. The tapered annular stack may comprise multiple sections.

An in-line fan having an annular outlet which communicates with the bottom of the tapered annular stack is preferably included for impelling exhaust gas admitted to the inlet of the fan into the stack. The in-line fan preferably includes a motor mounted in an interior compartment and a centrifugal wheel for exhausting gases into an annular region formed between the interior compartment and the fan housing. The interior of the fan housing includes vanes for guiding the exhaust gas through the annular region formed between the interior compartment and the fan housing into the tapered annular stack. Preferably, an air intake passes through the fan housing and into the interior compartment where the fan motor is mounted, and fresh air is drawn through the air intake into the interior compartment around the motor and into the annular region formed between the interior compartment and the fan housing by means of auxiliary fan blades mounted on the obverse of the centrifugal wheel for cooling the fan motor.

A mixing chamber having an outlet which communicates with the inlet of the in-line fan through a cone included in the fan is preferably included for mixing diluent fresh air with effluent fumes and gases which are admitted to the inlet of the mixing chamber through the roof of an industrial plant for diluting the effluent fumes and gases as well as increasing the volume of gas to be discharged in order to achieve the desired discharge velocity in the event that the amount of exhaust gas varies. The mixing chamber includes one or more louvers and adjustable dampers for admitting diluent fresh air.

The tapered annular stack, especially in combination with the in-line fan and mixing chamber, provides a less costly and a more attractive exhaust or ventilation system than a conventional chimney having an equivalent height. The reduced cost and aesthetic appearance of the apparatus for discharging exhaust gas in accordance with the principles of the invention are attainable without any sacrifice in the air quality in the vicinity of the industrial plant.

BRIEF DESCRIPTION OF THE DRAWINGS

The above and other objectives and features of this invention and the concomitant advantages of the invention will be better understood by those skilled in the art after consideration is given to the following description of a preferred embodiment which is given in connection with the accompanying drawings. In the drawings.

DESCRIPTION OF A PREFERRED EMBODIMENT

Figures 1, 2, 3:
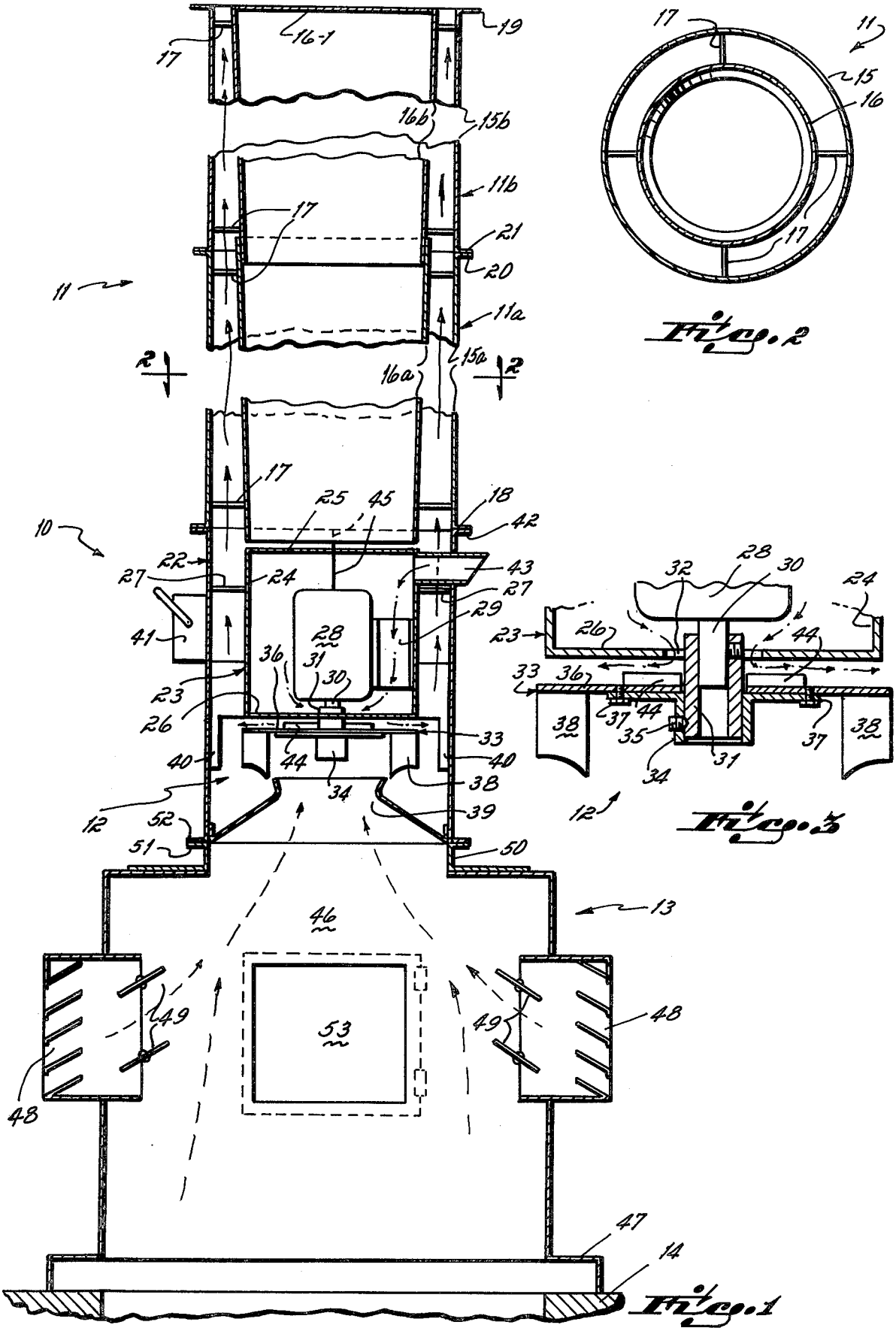
FIG. 1 is a vertical cross-sectional view of a preferred embodiment of the high discharge velocity exhaust system of the invention.
FIG. 2 is a view along line 2—2 in FIG. 1.
FIG. 3 is a detail of a portion of FIG. 1.

The preferred embodiment of the apparatus for discharging exhaust at a high velocity in accordance with the principles of this invention is indicated generally by the reference numeral 10 in the drawings. High discharge velocity exhaust system 10 includes a stack 11 for achieving a relatively high discharge velocity for exhaust gas so that the effective height of the stack is equivalent to that of a considerably taller conventional chimney. Preferably, high discharge velocity exhaust system 10 also includes an in-line fan 12 for impelling exhaust gas into stack 11. Furthermore, high discharge velocity exhaust system 10 preferably includes a mixing chamber 13 for mixing diluent fresh air with fumes and exhaust gases evolved during an industrial process in an industrial plant, only the roof 14 of which is shown in the drawings.

As shown in FIGS. 1 and 2, stack 11 of high discharge velocity exhaust system 10 includes an outer wall 15 and a coaxial inner wall 16. Outer wall 15 and inner wall 16 are preferably constructed from sheet metal. Inner wall 16 is preferably mounted coaxially within outer wall 15 by means of a plurality of rod brackets 17 welded between the inner wall and the outer wall. Outer wall 15 includes one flange 18 at the bottom of stack 11 and preferably includes another flange 19 at the top of the stack to which may be mounted a rain deflector (not shown) or for another reason which will be described shortly.

As also shown in FIGS. 1 and 2, outer wall 15 is preferably cylindrical, and inner wall 16 tapers outwardly toward the outer wall from the bottom to the top of stack 11, thereby providing the appearance of a cylindrical stack. Stack 11, for example, might be seven feet tall, the inside diameter of outer wall 15 might be 24 25/32 inches, and the outside diameter of inner wall 16 might be $18\frac{1}{4}$ inches at the bottom of the stack and $21\frac{3}{8}$ inches at the top of the stack. However, one contemplated modification of stack 11 would include a cylindrical inner wall and a coaxial outer wall which tapers inwardly toward the inner wall from the bottom to the top of the stack, thereby providing the appearance of a tapered stack. In either case, the tapered annular region formed between outer wall 15 and inner wall 16 of stack 11 as shown in FIG. 2 defines the region through which exhaust gas flows through the stack as indicated by the arrows in FIG. 1. That is, stack 11 is a tapered annular stack for achieving a relatively high discharge velocity for exhaust gas so that the effective height of the stack is equivalent to that of a considerably taller conventional chimney. Preferably, the region within inner wall 16 is sealed off at the top of stack 11 by any suitable means, such as a plate 16-1 welded to the inner wall at the top of the stack.

As shown in FIG. 1, stack 11 may comprise multiple sections, for example, a lower section **11*a* and an upper section 11*b*. In that case, outer wall 15*a* of lower section 11*a* includes not only flange 18 but also a distal flange 20. Furthermore, inner wall 16*a* of lower section 11*a* extends beyond flange 20. Also, outer wall 15*b* of upper section 11*b* includes not only flange 19 but also a distal flange 21. Furthermore, inner wall 16*b* of upper section 11*b* extends beyond flange 21. Upper section 11*b* is interfitted with lower section 11*a* by telescoping inner wall 16*b* of the upper section within inner wall 16*a* of the lower section until flanges 20 and 21 abut and then bolting those flanges together, for example. The diameter of inner wall 16*b* of upper section 11*b* is preferably one gauge smaller than the diameter of inner wall 16*a* of lower section 11*a* for facilitating a snug frictional connection when they are telescoped together. If another section is needed in order for stack 11 to achieve the desired discharge velocity, the plate 16-1 welded to inner wall 16 at the top of the stack could be removed and another section could be interfitted with upper section 11*b* and bolted to flange 19**.

As shown in FIGS. 1 and 3, in-line fan 12, which is preferably combined with stack 11 in high discharge velocity exhaust system 10, includes a housing 22. Fan 12 also includes an interior compartment 23. Interior compartment 23 includes a cylindrical wall 24 which is closed at the top by means of a top wall 25 and closed at the bottom by a bottom wall 26. Housing 22 and interior compartment 23 are preferably constructed from sheet metal. Interior compartment 23 is preferably mounted coaxially within housing 22 by means of a plurality of rod braces 27 and guide vanes 40 welded between cylindrical wall 24 of the interior compartment and the housing.

Fan 12 also includes an electric motor 28 coaxially mounted within interior compartment 23. For example, a bracket 29 may be mounted to cylindrical wall 24 of interior compartment 23, and motor 28 may in turn be bolted to the bracket.

As best shown in FIG. 3, motor 28 includes a driveshaft 30 to which an extension 31 in the form of a metal tube is press-fitted, swedged, or otherwise secured. Extension 31 extends through a hole 32 provided in the center of bottom wall 26 of interior compartment 23.

Fan 12 also includes a centrifugal wheel 33 driven by means of motor 28. Centrifugal wheel 33 includes a hub 34 mounted on extension 31, for example, by means of a set screw 35. Centrifugal wheel 33 also includes a backplate 36 mounted on hub 34 by means of bolts 37 or the like. Centrifugal wheel 33 also includes a plurality of fan blades 38 mounted on the face of backplate 36 by the process of welding, for example.

Fan 12 also includes a cone 39 bolted or otherwise coaxially mounted within housing 22. Fan 12 further includes guide vanes 40 mounted on housing 22 between the housing and the periphery of centrifugal wheel 33.

Fan 12 is for impelling exhaust gas into stack 11. When motor 28 is energized by connecting the motor to a source of electrical power by means of a disconnect switch 41, the motor drives centrifugal wheel 33 for impelling exhaust gas into cone 39 which forms the inlet of fan 12 and throws the exhaust gas so that the exhaust gas flows radially outwardly toward housing 22 whereupon guide vanes 40 mounted on the housing between the housing and the periphery of the centrifugal wheel redirect the flow of exhaust gas through the annular region between the housing and interior compartment which forms the outlet of the fan. The flow of exhaust gas through fan 12 and thence through stack 11 is indicated by the arrows in FIG. 1. Since the annular outlet of fan 12 communicates directly with the bottom of tapered annular stack 11, exhaust gas flows efficiently to the top of the stack. Therefore, a relatively low horsepower energy conserving motor 28 can be used. Preferably, housing 22 includes a flange 42 to which flange 18 of outer wall 15 is bolted so that the annular region of fan 12 formed between housing 22 and interior compartment 23 communicates with the tapered annular region formed between outer wall 15 and inner wall 16 at the bottom of stack 11.

Preferably, fan 12 further includes an air intake 43 which passes through housing 22 and the annular region formed between the housing and interior compartment and into the interior compartment 23 where motor 28 is mounted. Furthermore, hole 32 in bottom wall 26 of interior compartment 23 is made slightly larger in diameter than the diameter of extension 31 so that there is an annular gap between the edges of the hole and the periphery of the extension. Finally, fan 12 also preferably includes auxiliary fan blades 44 mounted on the obverse of backplate 36 of centrifugal wheel 33 by the process of welding, for example. Consequently, when motor 28 is energized in order to drive centrifugal wheel 33 for impelling exhaust gas through fan 12 and stack 11, auxiliary fan blades 44 draw fresh air through air intake 43 into interior compartment 23 around the motor and through the annular gap formed between the edges of hole 32 in bottom wall 26 of the interior compartment and the periphery of extension 31 and throw the fresh air radially outwardly toward the housing into the flow of exhaust gas as indicated by the dotted arrows in FIG. 1. As a result, motor 28 is cooled. Also entry of exhaust gas into interior compartment 23 through the annular gap is prevented.

Preferably, housing 22 and interior compartment 23 are constructed in two vertical halves which are connected along one pair of confronting edges by means of a hinge 45 so that motor 28 and centrifugal wheel 33 can be easily accessed for maintenance or repair. Alternatively, access doors (not shown) could be provided for access.

As shown in FIG. 1, mixing chamber 13, which is preferably combined with stack 11 and fan 12 in high discharge velocity exhaust system 10, includes a plenum 46 preferably constructed from sheet metal. Plenum 46 includes a base 47 for mounting the plenum on roof 14 of an industrial plant by means of bolts, for example. Plenum 46 also includes louvers 48 in the sides of the plenum and adjustable dampers 49.

Mixing chamber 13 is for diluting the exhaust gas as well as increasing the volume of gas to be discharged in order to achieve the desired discharge velocity. When motor 28 is energized in order to drive centrifugal wheel 33 for impelling exhaust gas through fan 12 and stack 11, the suction which is created by the fan causes exhaust gas evolved during industrial processes to flow through base 47 which forms the inlet of plenum 46 and causes fresh air to flow into the plenum through louvers 48 and dampers 49 as indicated by the dashed arrows in FIG. 1. The diluted exhaust gas is then impelled into fan 12 as indicated by the arrows in FIG. 1 through a fitting 50 which forms the outlet of plenum 46. Preferably, fitting 50 includes a flange 51 to which a flange 52 included in housing 22 is bolted so that the outlet of plenum 46 formed by fitting 50 communicates with the inlet of fan 12 formed by cone 39. Plenum 46 may be provided with a hinged access door 53 so that dampers 49 can be easily accessed for maintenance and repair.

Tapered annular stack 11, especially in combination with fan 12 and mixing chamber 13, provides a less costly and more attractive exhaust or ventilation system than a conventional chimney having an equivalent height. That is, the discharge velocity of exhaust gas achieved by stack 11, fan 12, and mixing chamber 13 causes exhaust gas to be discharged upwardly into the atmosphere to a height comparable to the height achieved by a considerably taller conventional chimney. Therefore, the reduced cost and aesthetic appearance of the apparatus for discharging exhaust gas in accordance with the principles of this invention are attainable without any sacrifice in the air quality in the vicinity of the industrial plant.

A preferred embodiment of the high discharge velocity exhaust system in accordance with the principles of the invention has been described by way of example and not by way of limitation. Various possible modifications have been described, and other modifications may appear to those skilled in the art without departing from the scope and spirt of the invention. In order to ascertain the true scope of the invention in which an exclusive right is claimed, reference must be made to the appended claims.

We claim:

1. An apparatus for discharging exhaust gas at high velocity comprising:

a cylindrical stack, said stack including, (a) an outer wall and (b) a coaxial inner wall forming an annular, substantially cylindrical passage for gasses, one of said outer and inner walls being a substantially cylindrical wall and the other of said outer and inner walls being tapered toward said cylindrical wall from the bottom to the top of said stack so that said stack has a tapered annular cross-section, said cylindrical passage at its upper end being free from obstruction to the high velocity vertical discharge of exhaust gases, an in-line fan for impelling exhaust gas admitted to the inlet of said fan to the outlet of said fan, the outlet of said fan being in communication with the bottom of said cylindrical passage, whereby said stack achieves a relatively high discharge velocity for exhaust so that the effective height of said stack is equivalent to that of a considerably taller cylindrical chimney.

2. The apparatus in claim 1 wherein said outer wall is cylindrical and said inner wall tapers outwardly toward said outer wall from the bottom to the top of said stack.

3. The apparatus in claim 1 or 2 wherein said stack comprises multiple sections.

4. The apparatus in claim 1 further comprising:

an in-line fan including:

a cylindrical housing, a cylindrical interior compartment coaxially mounted within said cylindrical housing and defining a cylindrical annulus, said interior compartment having a cylindrical wall, a top wall, and a bottom wall, a motor mounted on said cylindrical wall of said interior compartment, said motor having a driveshaft coaxial with said housing and interior compartment which extends through a hole provided in the center of said bottom wall of said interior compartment, said housing annulus being connected straight and vertically to said stack cylindrical passage, a centrifugal wheel mounted on said driveshaft immediately below and centered within said housing annulus, whereby said centrifugal wheel will drive gasses flowing into said housing annulus straight up the stack and into the atmosphere well above said stack.

5. The apparatus in claim 4 further comprising:

an air intake, said air intake being passed through said housing and into said interior compartment where said motor is mounted, and auxiliary fan blades mounted on the obverse of said centrifugal wheel;

said auxiliary fan blades for drawing fresh air through said air intake into said interior compartment around said motor and through the annular gap formed between the edges of said hole and the periphery of said driveshaft into the annular region formed between said housing and said interior compartment;

whereby said motor is cooled.

6. The apparatus in claim 4 or 5 further comprising:

a mixing chamber having an inlet for exhaust gas and an outlet in communication with said housing annulus;

means for admitting fresh air to said mixing chamber;

said mixing chamber for mixing diluent fresh air with exhaust gas admitted to the inlet of said mixing chamber for diluting said exhaust gas as well as increasing the volume of gas to be discharged in order to achieve the desired discharge velocity.

7. An apparatus for discharging exhaust gas at high velocity comprising:

a cylindrical stack whose height is at least as great as its diameter, said stack including (a) an outer wall and (b) a coaxial inner wall forming an annular, substantially cylindrical passage for gasses;

one of said outer and inner walls being a substantially cylindrical wall and the other of said outer and inner walls being tapered toward said cylindrical wall from the bottom to the top of said stack so that said stack has a tapered annular cross-section; and said cylindrical passage, at its upper end, being free from obstruction to the high velocity vertical discharge of exhaust gases;

an in-line fan for impelling exhaust gas admitted to the inlet of said fan to the outlet of said fan, the outlet of said fan being in communication with the bottom of said cylindrical passage;

whereby a relatively high discharge velocity for exhaust is achieved so that the effective height of said stack is equivalent to that of a considerably taller cylindrical chimney.

8. The apparatus in claim 1 or 7 further comprising:

a mixing chamber having an inlet for exhaust gas and an outlet in communication with the inlet of said fan;

means for admitting fresh air to said mixing chamber;

said mixing chamber for mixing diluent fresh air with exhaust gas admitted to the inlet of said mixing chamber for diluting said exhaust gas as well as increasing the volume of gas to be discharged in order to achieve the desired discharge velocity.

9. Apparatus for discharging contaminated gases from a process within a plant comprising:

a cylindrical stack whose height is at least as great as its diameter, said stack including:

a generally cylindrical outer wall and a coaxial inner wall forming an annular, substantially cylindrical passage for gases, said cylindrical passage, at its upper end, being free from obstruction to the high velocity vertical discharge of exhaust gases, a cylindrical housing below and co-extensive with said outer wall;

a cylindrical interior compartment coaxially mounted within said cylindrical housing, said housing and compartment defining between them a cylindrical housing annulus which is connected straight vertically to said stack cylindrical passage;

a motor mounted in said compartment;

a centrifugal wheel mounted immediately below said housing annulus and connected to said motor, a mixing chamber mounted below said housing and in communication with said housing annulus, said mixing chamber receiving gases from said plant process, and means for admitting fresh air into said mixing chamber;

whereby contaiminated gases within said plant will be mixed with fresh air in said mixing chamber, said centrifugal wheel will drive said mixture straight up said housing annulus and said stack cylindrical passage at a velocity which will eject the mixture high into the atmosphere.

10. The apparatus of claim 9 in which said fresh air admitting means is adjustable.

* * * * *